United States Patent [19]

Cherico

[11] Patent Number: 4,715,138

[45] Date of Patent: Dec. 29, 1987

[54] PLACARD HOLDER

[75] Inventor: John R. Cherico, Buffalo, N.Y.

[73] Assignee: Johnny Stopper Inc., Cheektowaga, N.Y.

[21] Appl. No.: 793,902

[22] Filed: Nov. 1, 1985

Related U.S. Application Data

[63] Continuation-in-part of Ser. No. 781,269, Sep. 30, 1985, abandoned.

[51] Int. Cl.[4] ..... G09F 21/04

[52] U.S. Cl. ..... 40/591; 40/588; 40/611

[58] Field of Search ..... 40/588, 591, 611, 10 R, 40/490, 209

[56] References Cited

U.S. PATENT DOCUMENTS

| | | | |
|---|---|---|---|
| 709,466 | 9/1902 | Butt | 40/611 |
| 758,088 | 4/1904 | Mixer | 40/611 |
| 1,430,980 | 10/1922 | Gideon | 40/611 |
| 1,674,264 | 6/1928 | Prather | 40/611 |
| 1,829,824 | 11/1931 | Forrester | 40/209 |
| 2,592,289 | 4/1952 | Joyner | 40/588 |
| 3,173,219 | 3/1965 | Yarder | 40/591 |
| 3,481,059 | 12/1969 | Lowmaster | 40/591 |
| 3,510,975 | 5/1970 | Lowmaster | 40/591 |
| 3,835,563 | 9/1974 | Hanstad | 40/209 |
| 4,002,140 | 1/1977 | Quinn et al. | 40/491 |
| 4,094,083 | 6/1978 | Fund | 40/588 |
| 4,106,229 | 8/1978 | Schmid | 40/588 |
| 4,282,667 | 8/1981 | Glade | 40/611 |

FOREIGN PATENT DOCUMENTS

| | | | |
|---|---|---|---|
| 8598 | of 1904 | United Kingdom | 40/611 |
| 2021945 | 12/1979 | United Kingdom | 40/611 |

*Primary Examiner*—John J. Wilson
*Assistant Examiner*—Cary E. Stone
*Attorney, Agent, or Firm*—Christel, Bean & Linihan

[57] ABSTRACT

A placard holder having a rigid base sheet utilizes a notched, rigid transparent panel and frame members for spacing the panel from the base sheet. The frame members, base sheet and transparent panel collectively provide a receptacle for holding a plurality of placards, and a notch defined in the panel facilitates the removal of placards from the holder or the interchanging of placards within the holder. A removable closure is hingedly connected to the transparent panel to provide a cover for the placard receptacle and includes a notch-receiving portion adapted to interfit with and substantially close the panel notch.

22 Claims, 6 Drawing Figures

Fig. 5.
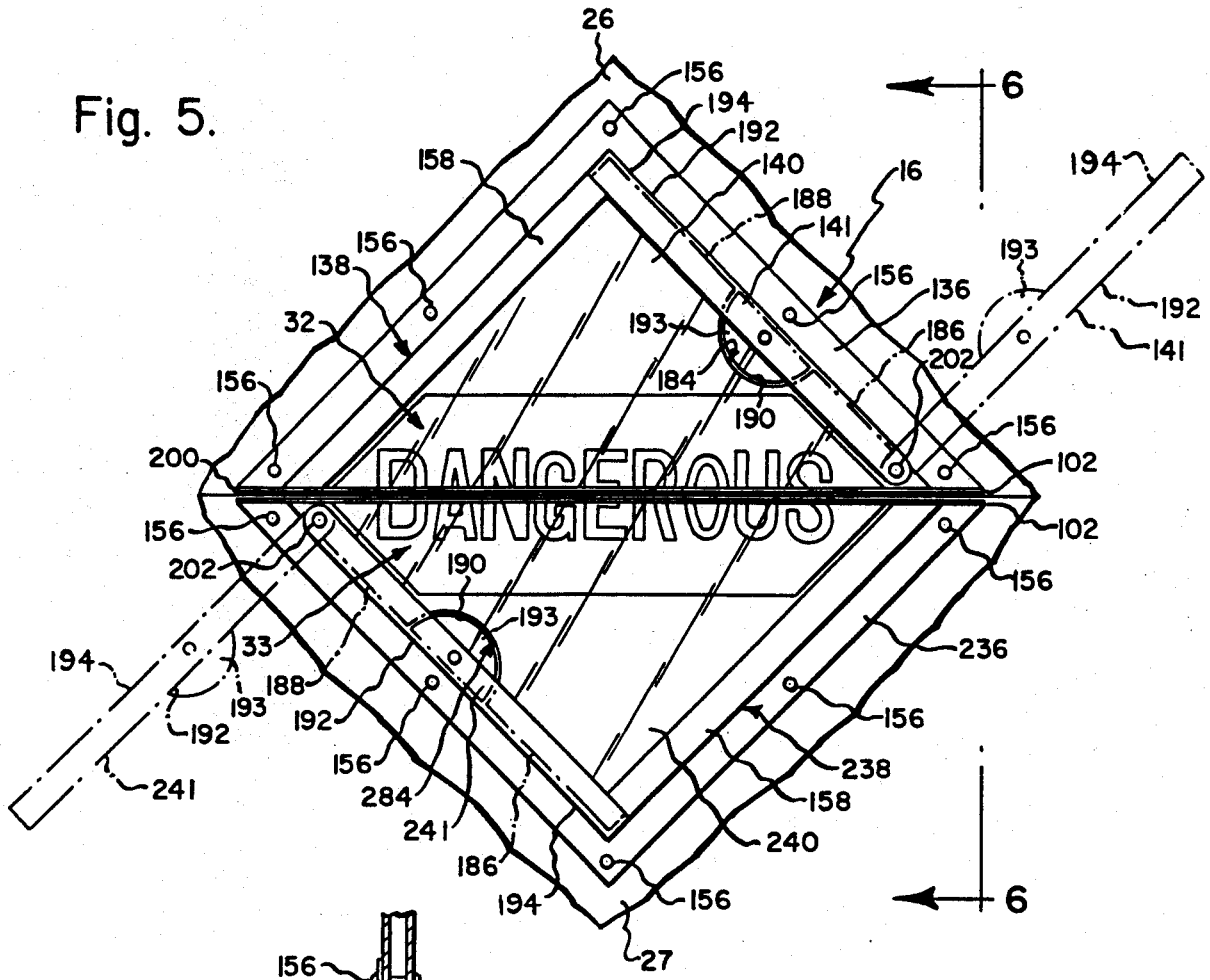
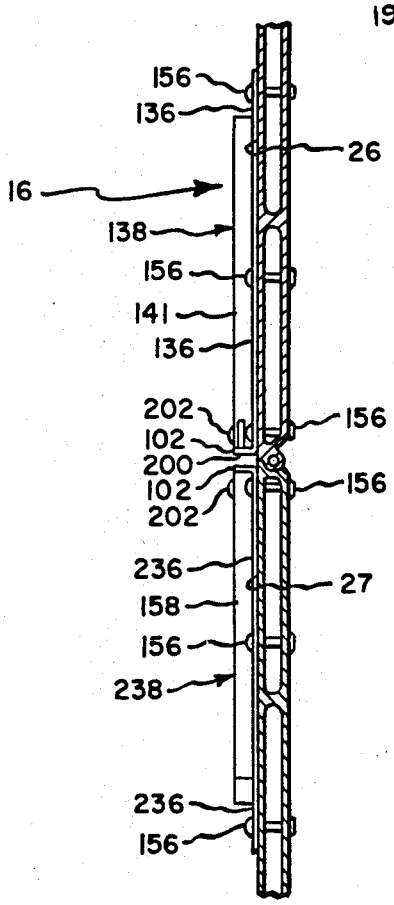
Fig. 6.

PLACARD HOLDER

CROSS REFERENCE TO A RELATED APPLICATION

This application is a continuation-in-part of my pending application Ser. No. 781,269 filed on Sept. 30, 1985, abandoned, and entitled Placard Holder.

BACKGROUND OF THE INVENTION

This invention relates generally to the mounting of placards on trucks or similar vehicles and relates, more particularly, to a holding apparatus in which placards are held for display.

The type of holder with which this invention is to be compared includes a base sheet of material adapted to be attached to a suitable surface of a vehicle, a transparent cover panel and a frame for securing edges of the transparent panel to the base sheet. An example of a holder of the aforedescribed type is shown and described in U.S. Pat. No. 3,771,243.

It is an object of the present invention to provide a new and improved placard holder.

Another object of the present invention is to provide such a holder for holding several placards at once wherein only one placard is exposed for viewing and the remaining placards are stored until needed.

Still another object of the present invention is to provide such a holder facilitating removal of a placard from the holder and the interchanging of placards within the holder.

Yet still another object of the present invention is to provide such a holder which is suited for use on a roll-up door of a vehicle.

A further object of the present invention is to provide such a holder which is durable in construction and economical to manufacture.

SUMMARY OF THE INVENTION

This invention resides in a placard holder for operatively displaying a placard.

The placard holder comprises means defining a rigid base sheet, means providing a rigid transparent panel arranged in spaced and parallel relationship with the base sheet, and frame means connected between the panel and the base sheet for supporting the panel in spaced relationship with the base sheet. The base sheet, panel and frame means collectively define a narrow, open-ended receptacle for holding a plurality of placards, and the receptacle defines an opening at the open end thereof permitting the passing of placards into and out of the receptacle. The panel includes an edge extending along the receptacle opening, and the edge defines a notch facilitating the removal of placards from and the interchanging of placards within the receptacle.

BRIEF DESCRIPTION OF THE DRAWING FIGURES

FIG. 5 is a plan view of the other of the FIG. 1 holder embodiments drawn to a slightly larger scale.

FIG. 6 is an elevation view of the holder embodiment shown in FIG. 5 as seen from the right in FIG. 5.

DETAILED DESCRIPTION OF ILLUSTRATIVE EMBODIMENTS

Figure 1:
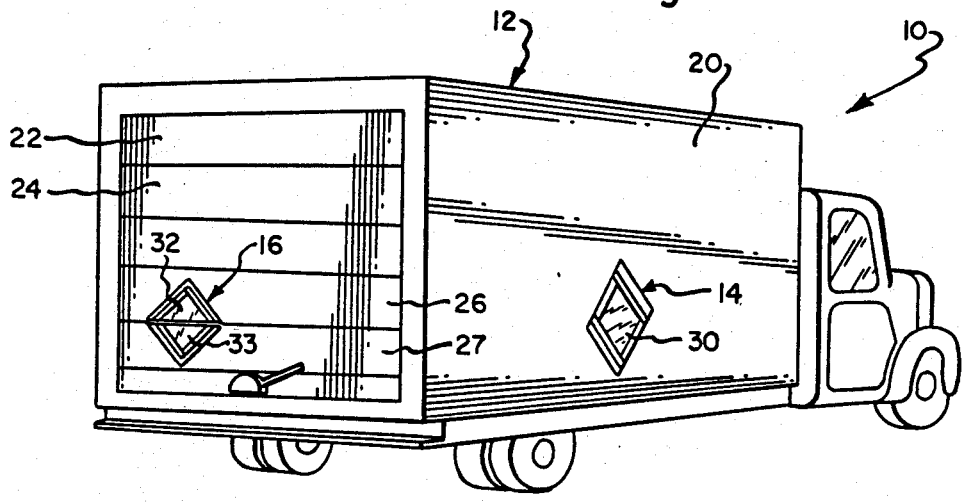
FIG. 1 is a perspective view of two embodiments of the placard holder in accordance with this invention shown mounted upon a truck.

Turning now to the drawings in greater detail and considering first FIG. 1, there is shown a truck 10 having a van 12 on which two embodiments, indicated generally 14 and 16, of the holder in accordance with the present invention are operatively mounted. The van 12 includes a vertically-oriented, flat side surface 20 and a back 22 in the form of a roll-up door 24 mounted along tracks (not shown) within the van 12. The roll-up door 24 includes a plurality of panels, such as those indicated 26,27, which are hingedly connected together along adjacent edges in a manner well known in the art to enable the door 24 to be lifted from a first condition, as shown in FIG. 1, at which the panels 26,27 are arranged substantially vertically to a second condition at which the panels 26,27 are oriented substantially horizontally and spaced a short distance beneath the roof of the van 12. As will be explained in greater detail hereinafter, the holder 14 is particularly well-suited for displaying a placard, generally indicated 30, upon the side 20 of the van 12, and the holder 16 is particularly well-suited for displaying placards, indicated 32 and 33, from the surface of the roll-up door 24.

Figure 2:
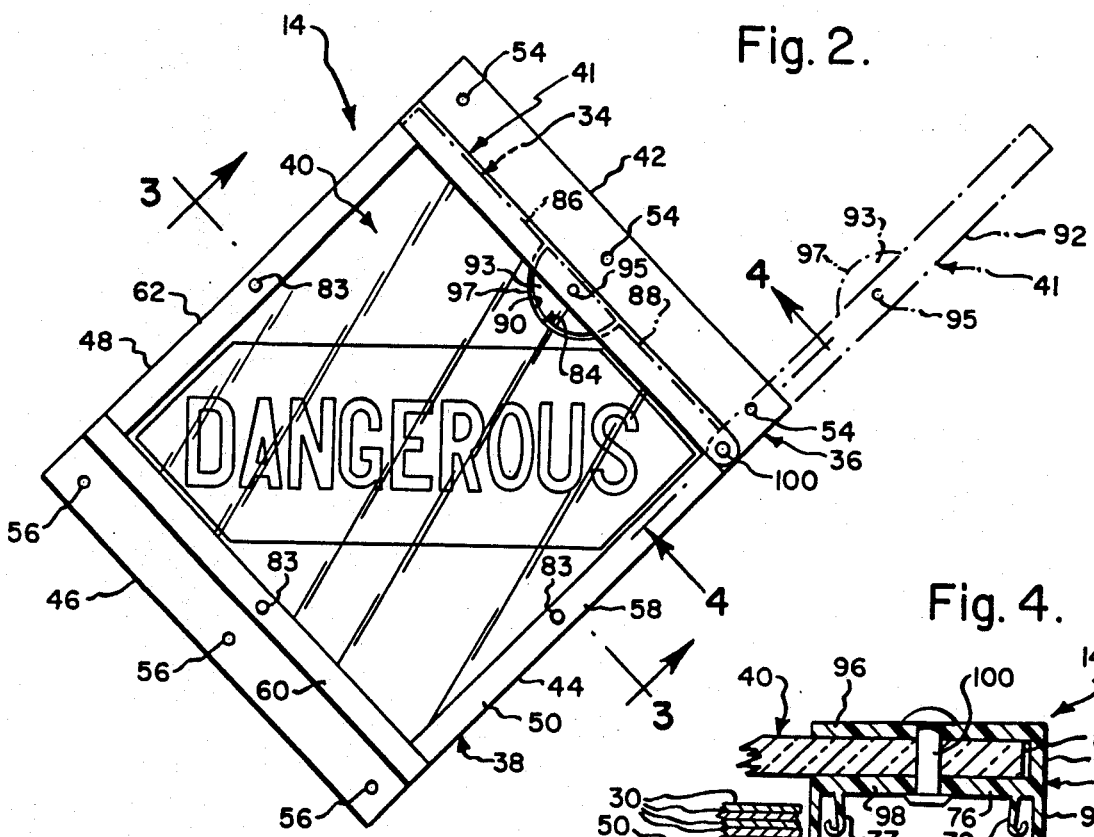
FIG. 2 is an elevation view of one of the FIG. 1 holder embodiments drawn to a slightly larger scale.
Figure 4:
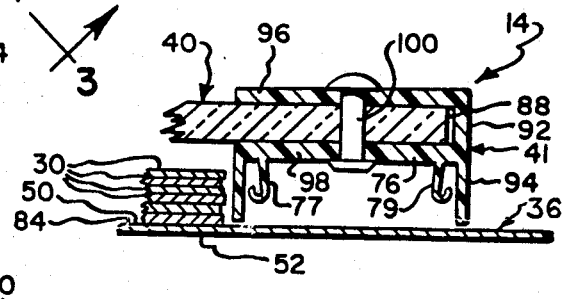
FIG. 4 is a cross-sectional view taken about line 4—4 of FIG. 2.
Figure 3:
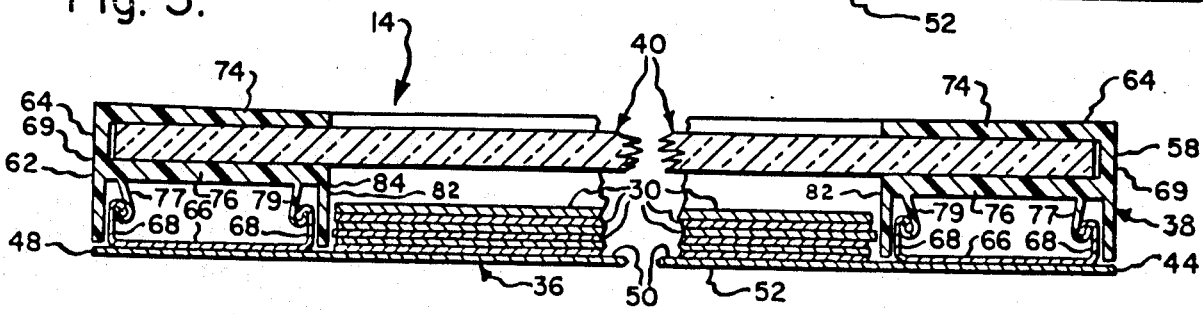
FIG. 3 is a cross-sectional view taken about lines 3—3 of FIG. 2.

With reference to FIGS. 2–4, the holder 14 includes means defining a base sheet 36 of rigid material, frame means 38, means defining a rigid transparent panel 40 and means providing a removable closure 41. The base sheet 36 is generally rectangular in shape and constructed of a suitable material such as sheet steel or a hard plastic. The base sheet 36 defines four edges 42, 44, 46, 48, a front surface 50, a back surface 52, three fastener-receiving mounting holes 54, 54 adjacent the sheet edge 42, and three fastener-receiving mounting holes 56, 56 adjacent the sheet edge 46. The mounting holes 54 and 56 permit the holder 14 to be attached to the sides of trucks of different styles such as may include a tanker or a ribbed van.

The frame means 38 includes three elongated members 58,60, 62 arranged along three edges 44, 46, 48 of the base sheet 36 so as to form three sides of an open-sided square frame. As best shown in FIG. 2, each member 58, 60 or 62 forms a right angle with its adjacent member.

With reference to FIG. 3, each frame member 58, 60 or 62 includes a resilient plastic extrusion 64 and thin metal strip 66. Each metal strip 66 includes two flanges 68, 68 positioned at opposite sides thereof defining a pair of parallel guide tracks extending to the side of the strip 66 opposite the base sheet 36.

Each plastic extrusion 64 which includes a body 69 defining two spaced and parallel lips 74,76 and cooperates with the flanges 68,68 of the strip 66 to securely interlock the extrusion 64 to the strip 66. More specifically, the body 69 includes two spaced ribs 77,79 shaped so as to interlock with the flanges 68,68 of the metal strip 66. The metal strip 66 is, in turn, secured to the base sheet 36 by suitable means such as glue, to thereby fixedly secure each frame member 58,60 or 62 to the base sheet 36.

With reference still to FIG. 3, lips 74,76 define a recess, or spacing, therebetween which opens generally inwardly of the frame defined by the frame means 34.

As will be apparent hereinafter, the recess accommodates an edge of the transparent panel positioned therebetween. Furthermore, one lip 76 defines a shoulder 82 extending generally at a right angle to the surface 50 of the base sheet 36 for a reason which will be hereinafter apparent.

With reference again to FIG. 2 and 3, the rigid transparent panel 40 is generally square in shape and is constructed of a plastic material such as is manufactured and sold under the tradename Plexiglass or Lexan. Three edges of the panel 40 are positioned within the recess defined between the lips 74,76 of the frame members 58,60 and 62 so as to be snugly retained therein. To this end, the panel edges are of such thickness that the resiliency of the extrusion body biases the lips 74,76 against opposite sides of the panel edges. Optional rivets 83,83 can be placed through the member extrusions to further secure the panel 40 to the members 58, 60, 62.

Collectively, the base sheet 36, frame means 38 and the panel 40 define a relatively narrow receptacle 84 for holding a plurality of placards 30,30 wherein the bottom and sides of the receptacle 84 are provided by the shoulders 82,82 of the frame members 58,60 and 62, the back of the receptacle 84 is provided by the base sheet 36, and the front of the receptacle 84 is provided by the panel 40. The receptacle 84 has a open end defining a relatively narrow opening 86 permitting the passing of placards into and out of the receptacle 84.

As best shown in FIG. 2 and in accordance with the present invention, the panel 40 defines an edge 88 extending along the receptacle opening 86 and a notch 90 defined in the edge 88. As shown in FIG. 2, the notch 90 is substantially semi-spherical in shape and is positioned substantially midway along the length of the edge 88. The notch 90 facilitates the removal of placards 30,30 from and the interchanging of placards within the receptacle 84.

With reference to FIGS. 2 and 4, the removable closure 41 includes an elongated member 92 hingedly connected at one end to a corner of the panel 40. The elongated member 92 includes a body 94 constructed of a resilient plastic having two spaced and parallel lips 96,98 defining a recess or spacing therebetween. The recess of the body 94 is of such size in relationship to the panel edge 88 to snuggly accept and thereby releasably retain the panel edge 88 when the body 94 is placed thereover. When panel edge 41 is operatively received by the recess of the body 94 along the entire length of the edge 41, the lip 98 covers the receptacle opening 86. For convenience of construction of the holder 14, the cross section of the closure body 94 can be identical to that of the extrusion body 69 of each frame member 58, 60 or 62.

As shown in FIG. 4, the elongated member 92 is hingedly secured to the panel 40 by means of a pivot pin 100. The pin 100 includes a shank which extends through the lips 96,98 of the member 92 and panel 40. The closure member 92 is thereby pivotally movable between a first or closed condition, shown in solid lines in FIG. 2, at which the panel edge 88 is snuggly accepted by the recess of the body 94 and a second or opened condition, shown in phantom in FIG. 2.

The removable closure 41 further includes a notch-receiving portion 93 adapted to interfit with the notch 90 when the closure 41 is moved into its closed condition so as to substantially close the notch 90. The portion 93 is in the form of a plate having a generally straight edge which is secured within the recess of the body 94 by means of a rivet 95. The portion 93 further includes an arcuate peripheral edge 97 having substantially the same outline as that of the notch 90 to provide a close, interfitting relationship between the portion 93 and notch 90.

The holder 14 is advantageous in that the spacing defined between the panel 40 and base sheet 36 is of such size to accept and accommodate a large number of placards placed therein. Therefore, several placards bearing alternative warnings such as FLAMMABLE GAS or POISON can all be stored within the holder receptacle until needed for proper identification of contents carried by the truck 10. For display of the desired placard within the holder 14, the desired placard is simply arranged within the holder 14 so that its warning is viewable through the panel 40. Inasmuch as common placards are blank on the side opposite the warning, the displayed placard can be simply reversed in the holder receptacle to expose the blank side when no placard warning is necessary.

The holder 14 provides a further advantage in that the rigid panel 40 protects a placard 30 within the holder 14 from dirt or mud and is easy to clean. The notch-receiving portion 93 covers and therby protects the portion of the placard 30 which would otherwise be exposed through the notch 90. Furthermore, it has been found that the temperature within the receptacle of the holder 14 is generally the same as that of the surrounding air so that no view-obstructing condensation is likely to accumulate on the panel 40.

For purposes of illustration, the following illustrative dimensions of the holder 14 are provided. The base sheet 36 is constructed of twenty-four gauge sheet metal and measures 12.38 inches (31.4 cm) by 15 inches (38.1 cm). The frame members 58,60 and 62 are each about 0.75 inches (1.9 cm) wide and accommodate a panel measuring 12.25 inches (31.1 cm) square and 0.13 inches (0.32 cm) in thickness. The spacing between the panel 40 and base sheet 36 is about 0.25 inches (0.64 cm) and has been found to accommodate about twenty placards placed therein.

With reference to FIGS. 5 and 6, there are shown plan and elevation views of the FIG. 1 holder embodiment 16. The holder 16 includes means defining two rigid base sheets 136,236, means defining two rigid transparent panels 140,240, frame means 138 and 238 and two removable closures 141 and 241. Each base sheet 136 or 236 is generally triangular in shape defining interior angles of about forty-five, forty-five and ninety degrees and as best shown in FIG. 6, is folded along one edge to define a lip or ledge 102. Fastener-receiving holes 156,156 are defined along two edges of each base sheet 136 or 236 as shown.

Each frame means 138 or 238 includes an elongated member 158 and a corresponding base sheet ledge 102 arranged so as to form two sides of an open-sided triangular frame. As best shown in FIG. 5, each member 158 and corresponding ledge 102 generally forms a forty-five degree angle. Each frame member 158 includes a resilient plastic extrusion and interlocking metal strip as do each of the members 58,60 or 62 of the holder 14 of FIGS. 1–4 and is of identical cross section. Each frame member 158 is secured to its corresponding base sheet 136 or 236 with glue.

The transparent panels 140,240 are each generally triangular in shape with a notched edge 188 and two additional edges. One of the additional edges is snuggly retained by the frame member 158 while the other additional edge abuts the ledge 102. Together, the base sheet 136, frame means 138 and panel 140 collectively define a first, or upper, receptacle 184 for holding a plurality of placards 32, and the base sheet 236; frame means 238 and panel 240 collectively define a second or lower receptacle 284 for holding a plurality of placards 33.

Each of the first or second receptacle has an open end defining a relatively narrow opening 186 permitting the passing of placards 32 or 33 into and out of the receptacle.

The notched edge 188 extends along the opening 186 of each receptacle 184 or 284 and includes a semi-spherical-shaped notch 190 positioned midway along the length of the edge 188. The notch 190 facilitates the removal of placards from and the interchanging of placards within its corresponding receptacle.

Each removable closure 141 or 241 includes an elongated member 192 hingedly connected at one end to a corner of a panel 140 or 240. The elongated member 192 includes a body 194 constructed of a resilient plastic having the identical cross-sectional shape as that of the closure body 94 of the holder 14 of FIGS. 1–4. Pivot pins 202,202 pivotally secure the closures 141 and 241 to the panels 140 and 240 for movement between a closed condition, shown in solid lines in FIG. 5, at which each member body 194 snuggly accepts a panel edge 188 or 188 and covers a receptacle opening and an opened condition, shown in phantom in FIG. 5.

Each removable closure 141 or 241 further includes a notch-receiving portion 193 or 293 secured within the recess of the body 192 by means of a rivet. The portions 193 and 293 are of such shape and size that when the closures 141 and 241 are in the closed conditions, the portions 193 and 293 are closely accepted by and interfit with the panel notches 190 and 190.

As best shown in FIG. 5, each placard 32 or 33 is triangular in shape and comprises one-half of a sign indicating the word DANGEROUS. When mounted adjacent one another in the manner shown, the holder receptacles 184 and 284 are split so as to define a gap indicated 200 between two opposite corners of the holder 16.

When mounting the holder 16 upon the roll-up door 24 of the FIG. 1 truck 10, the upper receptacle 184 is attached to the panel 26 of the door 24 so that its base sheet ledge 102 extends across the lower edge of the panel 26. The lower receptacle 284 is attached to the door panel 27 so as to be positioned directly beneath the receptacle 184 with its base sheet ledge 102 extending across the upper edge of the door panel 27 so that the sign comprised of the placards 32 and 33 is essentially complete and understandable. Thus, when the panels 26 and 27 hingedly move relative to one another along their joined edges, the holder 16 effectively folds about the gap 200.

For purposes of illustration, the following illustrative dimensions of the holder 26 are provided. The base sheets 136,236 are each constructed of twenty-four gauge sheet metal and measures 14.5 inches (36.8 cm) across two short edges and 20.5 inches (52.1 cm) across the remaining longer edge. The frame member 158 and closure member 192 of each receptacle 184 or 284 accommodates a transparent panel measuring 12.5 inches (31.8 cm) across two edges, 17.25 inches (43.8 cm) across the remaining edge, and 0.25 inches (0.64 cm) in thickness. The width of the ledge 102 is about 0.44 inches (1.1 cm), and the overall thickness of the holder 16 is no greater than 0.5 inches (1.3 cm).

It will be understood that numerous modifications and substitutions can be made to the aforedescribed embodiments 14 and 16 without departing from the spirit of the invention. For example, although each frame members 58,60 and 62 of the holder 14 have been shown as squarely abutting one another at the frame corners, the frame members 58,60 and 62 can be formed at each end so as to define a miter joint with its adjacent member 58,60 or 62. Accordingly, the aforedescribed embodiments are intended for the purpose of illustration and not as limitation.

I claim:

1. A placard holder comprising:

means defining a rigid base sheet;

means providing a rigid transparent panel arranged in spaced and parallel relationship with said base sheet; and frame means connected between said panel and said base sheet for supporting said panel in spaced relationship with said base sheet, said base sheet, panel and said frame means collectively defining a relatively narrow, open-ended receptacle for holding a plurality of placards, said receptacle defining an opening at the open end thereof permitting the passing of placards into and out of said receptacle, said panel includes one edge extending along said receptacle opening and said one edge defining a notch facilitating the removal of placards from and the interchanging of placards within said receptacle, said frame means including at least one elongated member having a securement portion secured to said base sheet and a holding portion to which said transparent panel is secured, said holding portion being a first unitary structure and said securement portion being a second unitary structure including a thin strip portion and means defining a pair of parallel guide tracks, said thin strip portion extending along the length of said elongated member and defining two opposite edges and a planar surface engaging said base sheet, said parallel guide tracks joined to a corresponding edge of said thin strip portion and directed generally from the side of said thin strip portion opposite said planar surface, and said holding portion includes means interlocked with said pair of guide tracks so that said holding portion and said securement portion are cooperatively interlocked with one another.

2. A holder as defined in claim 1 wherein said base sheet is constructed of metal.

3. A holder as defined in claim 1 wherein said base sheet defines a plurality of fastener-receiving apertures for attachment of said holder to a surface upon which a placard is to be displayed.

4. A holder as defined in claim 1 wherein said frame means includes at least one elongated member having a securement portion secured to said base sheet and a holding portion to which said transparent panel is secured.

5. A holder as defined in claim 4 wherein said holding portion is constructed of an elastomeric material and includes means defining a recess snugly accepting an edge of said panel.

6. A holder as defined in claim 5 wherein said holding portion is constructed of plastic.

7. A holder as defined in claim 4 wherein said holding portion is a first unitary structure and said securement portion is a second unitary structure, and said holding portion and said securement portion cooperatively interlock with one another.

8. A holder as defined in claim 4 wherein said frame means includes three elongated members arranged against said base sheet so as to define an open-sided rectangular frame and said receptacle opening is defined across the open side of said defined frame.

9. A holder as defined in claim 1 wherein said holding portion is constructed of an elastomeric material and includes two spaced and generally parallel lips between which is snugly received an edge of the transparent panel to secure said panel to said elongated member.

10. A holder as defined in claim 9 wherein said holding portion is constructed of plastic.

11. A holder as defined in claim 1 further comprising a removable closure securable across said receptacle opening.

12. A holder as defined in claim 11 wherein said removable closure includes means defining a recess for snuggly accepting said one panel edge to releasably secure said closure to said transparent panel and means defining an opening-covering portion for closing said receptacle opening when said removable closure is secured to said one edge.

13. A holder as defined in claim 1 wherein said notch is positioned substantially midway along the length of said edge.

14. A holder as defined in claim 1 wherein said base sheet is a first base sheet, said panel is a first panel, said frame means is a first frame means, said base sheet-defining means defines a second rigid base sheet, said panel-providing means provides a second rigid transparent panel and said holder further comprises a second frame means, said second panel arranged in spaced and parallel relationship with said second base sheet, said second frame means connected between said second panel and said second base sheet for supporting said second panel in spaced relationship with said second base sheet, said second base sheet, second panel, and said second frame means collectively defining another narrow, open-ended receptacle for holding a plurality of placards, said another receptacle defining an opening at the open end thereof permitting the passing of placards into and out of said another receptacle, said second panel having a single edge extending along said another receptacle opening, said single edge defining a notch facilitating the removal of placards from and the interchanging of placards within said another receptacle, said first and second base sheets adapted to be mounted adjacent one another for display of two placards in side-by-side relationship.

15. A placard holder comprising:

means defining a rigid base sheet;

means providing a rigid transparent panel arranged in spaced and parallel relationship with said base sheet;

frame means connected between said panel and said base sheet for supporting said panel in spaced relationship with said base sheet, said base sheet, panel and said frame means collectively defining a relatively narrow, open-ended receptacle for holding a plurality of placards, said receptacle defining an opening at the open end thereof permitting the passing of placards into and out of said receptacle, said panel includes one edge extending along said receptacle opening and said one edge defining a notch facilitating the removal of placards from and the inter changing of placards within said receptacle; and a removable closure securable across said receptacle opening and including means defining a recess for snuggly accepting said one panel edge to releasably secure said closure to said transparent panel and means defining an opening-covering portion for closing said receptacle opening when said removable closure is secured to said one edge, said removable closure being constructed of an elastomeric material and said recess defines opposing walls between which said one panel edge is accepted so that when said closure recess accepts said one edge, the resiliency of said closure forces the walls of said recess into frictionally gripping engagement with said panel adjacent said one edge.

16. A holder as defined in claim 15 wherein said removable closure is hingedly connected to the remainder of said holder to permit said closure to be pivotally moved relative to said one panel edge between a closed condition at which said recess snuggly accepts said one edge and an opened condition.

17. A holder as defined in claim 15 wherein said removable closure is elongated and has two opposite ends portions, said one panel edge has two opposite end portions, and one end portion of said removable closure is pivotally joined to one end portion of said one panel edge.

18. A placard holder comprising:

means defining a rigid base sheet;

means providing a rigid transparent panel arranged in spaced and parallel relationship with said base sheet;

frame means connected between said panel and said base sheet for supporting said panel in spaced relationship with said base sheet, said base sheet, panel and said frame means collectively defining a relatively narrow, open-ended receptacle for holding a plurality of placards, said receptacle defining an opening at the open end thereof permitting the passing of placards into and out of said receptacle, said panel includes one edge extending along said receptacle opening and said one edge defining a notch facilitating the removal of placards from and the inter changing of placards within said receptacle; and a removable closure securable across said receptacle opening and including means defining a recess for snuggly accepting said one panel edge to releasably secure said closure to said transparent panel and means defining an opening-covering portion for closing said secured to said one edge, said removable closure further including a notch-receiving portion adapted to interfit with said notch in said one panel edge when said removable closure accepts said one panel edge to substantially close said notch.

19. A holder as defined in claim 18 wherein said notch-receiving portion is securely retained within said recess and is in the form of a plate-like member having a peripheral edge having substantially the same outline as that of said notch.

20. A placard holder comprising:

a base sheet of rigid material;

frame means fixedly attached to said base sheet and arranged thereagainst so as to define an open-sided frame for accepting placards placed therein;

a rigid transparent panel supported by said frame means in spaced and parallel relationship with said base sheet and defining one edge extending generally across the open side of said defined frame, said base sheet, frame means and said panel collectively providing a placard receptacle, said receptacle defining an opening at the open side of said defined frame permitting the passing of said placards edgewise into and out of said receptacle, said one edge defining a notch facilitating the removal of placards from said receptacle; and a removable closure securable across said receptacle opening and including a holder a notch-receiving portion adapted to interfit with said notch in said one panel edge when said removable closure accepts said one panel edge to substantially close said notch.

21. A holder as defined in claim 20 further comprising a removable closure securable across said receptacle opening.

22. A holder as defined in claim 20 wherein said notch-receiving portion is securely retained within said recess and is in the form of a plate-like member having a peripheral edge having substantially the same outline as that of said notch.

* * * * *